United States Patent [19]

Kucherenko et al.

[11] 4,107,011

[45] Aug. 15, 1978

[54] METHOD OF REGENERATION OF SPENT ETCHING SOLUTIONS

[76] Inventors: Vladimir Ilich Kucherenko, ulitsa Sverdlova, 93, kv. 77; Valery Nikolaevich Flerov, ulitsa Kovalikhinskaya, 30, kv. 80; Georgy Vladimirovich Korolev, ulitsa Vaneeva, 49, kv. 12, all of Gorky; Evgeny Pavlovich Kotov, ulitsa Nedelina, 34, korpus 3, kv. 7, Moscow; Anatoly Mikhailovich Praporov, ulitsa Belovezhskaya, 77, kv. 159, Moscow; Galina Alexandrovna Batova, ulitsa Pravdy, 11, kv. 129, Moscow; Gayane Leonovna Melikova, ulitsa Orshanskaya, 4, kv. 49, Moscow; Alexandr Ivanovich Kolomeichuk, ulitsa Konenkova, 5, kv. 273, Moscow, all of U.S.S.R.

[21] Appl. No.: 767,228

[22] Filed: Feb. 9, 1977

Related U.S. Application Data

[63] Continuation-in-part of Ser. No. 666,156, Mar. 11, 1976, abandoned.

[30] Foreign Application Priority Data

Mar. 17, 1975 [SU] U.S.S.R. ..... 2110221

May 6, 1975 [SU] U.S.S.R. ..... 2131975

[51] Int. Cl.[2] ..... C25C 1/12; C25C 1/06

[52] U.S. Cl. ..... 204/151; 204/52 R; 204/94; 204/107; 204/112; 204/149

[58] Field of Search ..... 204/130, 149, 151, 86, 204/89, 208, 94, 107, 112, 52 R

[56] References Cited

U.S. PATENT DOCUMENTS

| | | | |
|---|---|---|---|
| 2,748,071 | 5/1956 | Eisler | 204/208 |
| 2,865,823 | 12/1958 | Harris et al. | 204/151 |
| 2,964,453 | 12/1960 | Garn et al. | 204/208 X |
| 3,761,369 | 9/1973 | Tirrell | 204/130 X |
| 3,788,915 | 1/1974 | Gulla | 204/130 X |

*Primary Examiner*—Arthur C. Prescott
*Attorney, Agent, or Firm*—Haseltine, Lake, & Waters

[57] ABSTRACT

The present invention is concerned with a method of regeneration of spent etching solutions containing cupric chloride and a metal chloride: cuprous chloride or ferrous chloride. These solutions are subjected to electrolysis with copper being reduced at the cathode and the metal chloride being oxidized at the anode. At the same time, chlorine is liberated at the anode, which is used for additional oxidation of the chloride of a metal.

The proposed method permits effective regeneration of etching solutions without polluting the environment.

5 Claims, No Drawings

METHOD OF REGENERATION OF SPENT ETCHING SOLUTIONS

The present application is a continuation-in-part of our co-pending application Ser. No. 666,156 filed Mar. 11, 1976 now abandoned.

The present invention relates to chemical and electrochemical treatment of metals, and more particularly to a method of regeneration of spent etching solutions.

Etching solutions are used for metal treatment, for example, in producing a printed-circuit pattern on copper printed wiring boards.

The proposed method permits regenerating spent copper-chloride or iron-copper-chloride etching solutions with simultaneous reduction of copper from the solution in the form of a metal powder at least 98% pure.

Known in the art are methods of electrochemical regeneration of spent etching solutions containing only one oxidizer ($FeCl_3$ or $CuCl_2$). Regeneration of such solutions is difficult and inefficient since it is impossible to combine the equivalence of the cathodic and anodic processes, maintain a constant etching capacity of the solutions and a high yield of metal at the cathode, and protect the environment at high intensity regeneration.

Therefore, by far the most interesting of the prior art solutions is a method of electrochemical regeneration of spent iron-copper-chloride etching solutions containing, for example, the following constituents, in g-mol/l:

ferric chloride: 1.34
ferrous chloride: 0.53
cupric chloride: 0.785
potassium chloride: 1.075
hydrochloric acid: 0.265

(cf. Zhurnal prikladnoi khimii, 1973, vol. 46, issue 2, pp. 324–328, "Cathodic Reduction of Copper from Spent Etching Solutions" by T. A. Balagurova, V. N. Kucherenko and V. N. Flerov).

A solution is regenerated by way of electrochemical oxidation, at the anode, of bivalent iron to trivalent iron with simultaneous liberation of chlorine and reduction of copper at the cathode. According to this method, the percentage yield of copper at the cathode is high (50 to 65% by weight) provided however, the concentration of copper in the solution is high. This fact is indicative of wide variations in the etching capacity of solutions. In addition, when solutions are regenerated at current densities above critical, the anodic and cathodic processes are not equivalent due to the gaseous chlorine being released into the atmosphere, which results in incomplete regeneration of the etching solution, and the latter has to be partially removed from the system which is replenished with fresh solution. To protect the environment, the liberated chlorine and effluents must be neutralized.

It is an object of the present invention to enhance the efficiency and intensity of the process of regeneration of spent etching solutions maintaining, at the same time, the equivalence of the cathodic and anodic processes.

Another object of the invention is to provide a method of regeneration of etching solutions, ruling out pollution of the environment.

With these and other objects in view, the invention resides in that in the proposed method of regeneration of spent etching solutions containing cupric chloride and a metal chloride namely, ferrous chloride or cuprous chloride, whereby electrochemical oxidation of the metal chloride takes place at the anode with simultaneous liberation of chlorine and reduction of copper at the cathode, according to the invention, the gaseous chlorine liberated during electrochemical oxidation is used for additional oxidation of the metal chloride.

To increase the degree of oxidation of the metal chloride at the anode, the electrochemical oxidation should preferably be conducted with the etching solution being fed along the anode countercurrent to the chlorine being liberated, at a linear speed at least one and a half times higher than that of the etching solution flowing along the cathode.

According to the invention, the solution subject to regeneration is a spent etching solution containing, in g-mol/l:

ferric chloride: 0.7 to 1.2
ferrous chloride: 0.32 to 0.4
cupric chloride: 0.98 to 1.5
chloride of an alkali metal: 1.1 to 2.0
hydrochloric acid: 0.2 to 0.8
water: up to 1 liter, and featuring a ferric chloride to cupric chloride ratio of 1:2.1 to 1.55:1.

This solution is subjected to electrolysis at a current density of 8 to 35 A/dm$^2$ with copper being reduced at the cathode and bivalent iron being oxidized at the anode to trivalent iron with simultaneous liberation of chlorine. The gaseous chlorine liberated during the electrochemical oxidation of iron is used for additonal oxidation of bivalent iron to trivalent iron until an etching solution of the following composition is obtained, in g-mol/l:

ferric chloride: 0.9 to 1.4
ferrous chloride: 0.12 to 0.2
cupric chloride: 0.9 to 1.4
chloride of an alkali metal: 1.1 to 2.0
hydrochloric acid: 0.2 to 0.8
water: up to 1 liter, with the same ferric chloride to cupric chloride ratio.

As to spent copper-chloride solutions, they can be electrolyzed at a current density of 15 to 80 A/dm$^2$.

The proposed method of regeneration of spent etching solutions should preferably be carried out as follows.

A spent etching solution containing, in g-mol/l:

ferric chloride: 0.7 to 1.2
ferrous chloride: 0.32 to 0.4
cupric chloride: 0.98 to 1.5
chloride of an alkali metal: 1.1 to 2.0
hydrochloric acid: 0.2 to 0.8
water: up to one liter, is regenerated at a current density of 8 to 35 A/dm$^2$ and a temperature of 10° to 40° C by successively passing the solution through the cathodic and anodic portions of a regeneration electrolyzer. In the method, use is preferably made of a 35% hydrochloric acid solution.

In this case, the solution in the anodic portion of the electrolyzer is directed countercurrent to the chlorine liberated at the anode, at a linear speed at least one and a half times greater than that of the solution being fed towards the cathode. The counterflow in the anodic portion permits not only limiting chlorine bubble formation at the anode, but also increasing the time of contact of the bubbles with the solution. In regenerators for small laboratory-type etching baths, used in small-lot production, the linear speed of the counterflow in the anodic portion can be selected 1.5 to 15 times greater than that of the solution in the cathodic portion. In regenerators for larger etching baths for lot production, said speed of counterflow should preferably be more than 15 times greater since in this case considerable accumulations of etched-away copper in the solution, hence, more intensive regeneration of spent solutions are involved. Meeting these requirements ensures economically feasible designs of regenerators for various applications.

After bivalent iron has been electrochemically oxidized in the regeneration electrolyzer, the solution is directed for additional chemical oxidation of the bivalent iron which has not reacted in the electrolyzer with the chlorine which is a byproduct of the electrochemical stage of regeneration. The chlorine is passed through a solution layer of a particular thickness, e.g., 10 to 50 cm.

The resulting etching solution has the following composition, in g-mol/l:

ferric chloride: 0.9 to 1.4
ferrous chloride: 0.12 to 0.2
cupric chloride: 0.9 to 1.4
chloride of an alkali metal: 1.1 to 2.0
hydrochloric acid: 0.2 to 0.8
water: up to 1 liter.

In the regenerated solution for etching printed circuit boards, the ratio of ferric chloride to cupric chloride is maintained from 1:2.1 to 1.55:1. This ratio corresponds to optimum etching capacity and high percentage yield of copper at the cathode when such a solution is regenerated after the etching process is over (50 to 75% by weight).

The limits of the range of total concentration of ferric chloride and cupric chloride have been selected equal to 1.8 and 2.8 g-mol/l because above 2.8 g-mol/l the solution becomes too viscous and below 1.8 g-mol/l oxidation is insufficient.

The introduction of a higher amount of ferrous chloride into the initial solution ensures the equivalence of the process of regeneration and precludes inadvertent release of the gaseous chlorine into the atmosphere during chemical oxidation of bivalent iron.

The selected ranges of component ratios in the solution substantially broaden the application of the etching solution owing to easier control of its composition without adversely affecting the efficiency of its regeneration.

A spent etching solution containing, in g-mol/l:

cupric chloride: 1.7 to 2.0
cuprous chloride: 0.2 to 0.3
potassium chloride: 2.5 to 3.5
hydrochloric acid: 0.2 to 0.8
water: up to 1 liter is regenerated at a current density of 15 to 80 A/dm$^2$ and a temperature of 10 to 40° C similarly as in the case of spent iron-copper-chloride etching solutions.

As a result, an etching solution of the following composition, in g-mol/l, is obtained:

cupric chloride: 1.76 to 2.06
cuprous chloride: 0.04 to 0.14
potassium chloride: 2.5 to 3.5
hydrochloric acid: 0.2 to 0.8
water: up to 1 liter.

The introduction of a higher amount of cuprous chloride within the specified range ensures the equivalence of the regeneration process and precludes spontaneous release of the gaseous chlorine into the atmosphere during chemical oxidation of univalent copper.

The advantages of the proposed method include the possibility of achieving the equivalence of the regeneration process and, in most cases, high yield of copper at the cathode (50 to 75% by weight). At the same time, the etching capacity of the solution is maintained constant and the environment is adequately protected since no release of noxious gases into the atmosphere and pollution of the effluent are involved. The etching capacity of the solution is fully restored and it is again ready for use, whereby a continuous process of etching printed circuit boards is ensured.

Therewith, the invariability of the etching capacity of the solution in the case of regeneration is provided for by setting a definite rate of extraction of copper from the solution (in g/l per hour) which should correspond to a similar rate of dissolution of copper during etching. The rate of dissolution of copper from printed circuit boards is normally determined by the maximum etching capacity of the solution and depends on the scale of production (small-lot or lot production), i.e. on the type of the etching machine.

For a better understanding of the invention, the following examples of its practical embodiment are given by way of illustration.

EXAMPLE 1

50 l of a spent etching solution containing, in g-mol/l:

ferric chloride: 0.7
ferrous chloride: 0.32
cupric chloride: 1.5
potassium chloride: 1.46
hydrochloric acid: 0.67
water: up to 1 liter, having a total concentration of ferric chloride and cupric chloride of 2.2 g-mol/l and a ratio of ferric chloride to cupric chloride of 1:2.1 are subjected to electrochemical regeneration under the following conditions:

current density: 20 A/dm$^2$
voltage: 4.7 V
precipitation time: 48 min
copper extraction rate: 6 g/l
solution temperature: 40° C.

The process is conducted with the etching solution being fed towards the anode in counterflow to the chlorine being liberated, the ratio of linear speeds in the anodic and cathodic portions being 1.5:1. The amount of chlorine liberated at the anode relative to the amount of electric power consumed is 9%. The liberated chlorine is used in the process of regeneration.

As a result, an etching solution of the following composition, in g-mol/l, is obtained:

ferric chloride: 0.9
ferrous chloride: 0.12
cupric chloride: 1.4
potassium chloride: 1.46
hydrochloric acid: 0.67
water: up to 1 liter, with a total concentration of ferric chloride and cupric chloride of 2.3 g-mol/l and a ratio therebetween of 1:1.55.

The etching capacity of the solution increases from 1.5 to 1.8 mg/cm$^2$.min.

The current yield of copper is 53% by weight or 0.1 g-mol/l.

EXAMPLE 2

50 l of a spent etching solution containing, in g-mol/l:

ferric chloride: 0.95
ferrous chloride: 0.32
cupric chloride: 1.25
potassium chloride: 1.46
hydrochloric acid: 0.8
water: up to 1 liter with a total concentration of ferric chloride and cupric chloride of 2.2 g-mol/l and a ratio therebetween of 1:1.31 are electrochemically regenerated during 67 minutes at a current density of 20 A/dm$^2$, a voltage of 4.7 V, a copper extraction rate of 6 g/l-per hour and a solution temperature of 40° C.

The process is conducted with the etching solution being fed towards the anode in counterflow to the chlorine being liberated, the ratio of linear speeds in the anodic and cathodic portions being 1.5:1. The amount of chlorine liberated at the anode relative to the consumed amount of electric power is 9%. The liberated chlorine is used in the process of regeneration.

The resulting etching solution has the following composition, in g-mol/l:

ferric chloride: 1.15
ferrous chloride: 0.12
cupric chloride: 1.15
potassium chloride: 1.46
hydrochloric acid: 0.8
water: up to 1 liter, with a total concentration of ferric chloride and cupric chloride of 2.3 g-mol/l and a ratio therebetween of 1:1.

The etching capacity of the solution improves from 2.0 to 2.3 mg/cm$^2$.min.

The current yield of copper is 38% by weight or 0.1 g-mol/l.

EXAMPLE 3

50 l of a spent etching solution containing, in g-mol/l:

ferric chloride: 1.2
ferrous chloride: 0.32
cupric chloride: 1.0
sodium chloride: 1.46
hydrochloric acid: 0.67
water: up to 1 liter, with a total concentration of ferric chloride and cupric chloride of 2.2 g-mol/l and a ratio therebetween of 2:1 are regenerated during 107 min under conditions similar to those of Example 1.

As a result, an etching solution of the following composition, in g-mol/l, is obtained:

ferric chloride: 1.4
ferrous chloride: 0.12
cupric chloride: 0.9
sodium chloride: 1.46
hydrochloric acid: 0.67
water: up to one liter, with a total concentration of ferric chloride and cupric chloride of 2.3 g-mol/l and a ratio therebetween of 1.55:1.

The etching capacity of the solution increases from 1.8 to 2.1 mg/cm$^2$.min. The current yield of copper is 24% by weight or 0.1 g-mol/l.

EXAMPLE 4

50 l of a spent etching solution containing, g-mol/l:

ferric chloride: 1.2
ferrous chloride: 0.32
cupric chloride: 1.16
potassium chloride: 1.46
hydrochloric acid: 0.67
water: up to 1 liter, with a total concentration of ferric chloride and cupric chloride of 2.36 g-mol/l and a ratio therebetween of 1.05:1.0 are regenerated under the following conditions:

current density: 15 A/dm$^2$
precipitation time: 60 min
copper extraction rate: 6 g/l
solution temperature: 40° C.

The obtained solution has the following composition, in g-mol/l:

ferric chloride: 1.4
ferrous chloride: 0.12
cupric chloride: 1.07
potassium chloride: 1.46
hydrochloric acid: 0.67
water: up to 1 liter, a total concentration of ferric chloride and cupric chloride of 2.47 and a ratio therebetween of 1.3:1.

The etching capacity of the solution increases from 1.45 to 1.81 mg/cm$^2$.min.

The current yield of copper is 53% by weight or 0.1 g-mol/l, the ratio of linear speeds in the anodic and cathodic portions being 1.5:1. The amount of chlorine liberated at the anode is 9%. The liberated chlorine is used in the process of regeneration.

EXAMPLE 5

A spent etching solution having a composition similar to that of the solution of Example 2, except that the content of hydrochloric acid therein is 0.2 g-mol/l, is subjected to electrochemical regeneration as in Example 2 with the difference that the ratio of linear speeds in the anodic and cathodic portions is 15:1.

In this case, the amount of chlorine liberated at the anode, relative to the amount of electric power consumed is 4%. The liberated chlorine is used in the process of regeneration. The current yield of copper is 38% by weight. The etching solution obtained as a result of regeneration has a composition as in Example 2 except that the hydrochloric acid concentration therein is 0.2 g-mol/l.

EXAMPLE 6

A spent etching solution of a composition similar to that of the solution of Example 2 is electrochemically regenerated as in Example 2, except that the ratio of linear speeds of the solution in the anodic and cathodic portions is 1:1.

In this case, the amount of chlorine liberated at the anode is 12% of the consumed amount of electric power. The current yield of copper is 38% by weight. The resulting etching solution has a composition as in Example 2.

EXAMPLE 7

A spent etching solution of a composition similar to that of the solution of Example 2 is electrochemically regenerated as in Example 2, except that the ratio of linear speeds of the solution in the anodic and cathodic portions is 0.5:1.

The amount of chlorine liberated in this case at the anode is 30% of the consumed electric power. The current yield of copper is 38% by weight.

The obtained etching solution has a composition as in Example 2.

EXAMPLE 8

50 l of a spent etching solution of the following composition, in g-mol/l:

cupric chloride: 1.88
cuprous chloride: 0.24
potassium chloride: 3.20
hydrochloric acid: 0.34
water: up to 1 liter, are electrochemically regenerated under the following conditions:

current density: 30 A/dm$^2$
voltage: 4.5 V
precipitation time: 60 min
copper extraction rate: 6.4 g/l
solution temperature: 40° C.

The process is conducted with the etching solution being fed towards the anode in counterflow to the chlorine being liberated, the ratio of linear speeds in the anodic and cathodic portions being 1.5:1. The liberated chlorine is used in the process of regeneration.

As a result, an etching solution of the following composition, in g-mol/l, is obtained:

cupric chloride: 1.98
cuprous chloride: 0.04
potassium chloride: 3.20
hydrochloric acid: 0.34
water: up to 1 liter.

The etching capacity of the solution increases from 3.5 to 3.9 mg/cm$^2$.min. The current yield of copper is 72% by weight.

EXAMPLE 9

50 l of a spent etching solution of the following composition, in g-mol/l:

cupric chloride: 1.88
cuprous chloride: 0.24
potassium chloride: 3.20
hydrochloric acid: 0.34
water: up to 1 liter, are subjected to electrochemical regeneration under the following conditions:

current density: 80 A/dm$^2$
voltage: 5.2 V
copper extraction rate: 6.4 g/l
precipitation time: 60 min
solution temperature: 40° C.

The process is conducted with the etching solution being fed towards the anode countercurrent to the chlorine being liberated the ratio of linear speeds of the etching solution in the anodic and cathodic portions being 1.5:1. The amount of chlorine liberated at the anode is 12% of the consumed electric power. The liberated chlorine is used in the process of regeneration.

As a result, an etching solution is obtained having the following composition, in g-mol/l:

cupric chloride: 1.98
cuprous chloride: 0.04
potassium chloride: 3.20
hydrochloric acid: 0.34
water: up to 1 liter.

The etching capacity of the solution increases from 3.5 to 3.94 g/cm$^2$.min. The current yield of copper is 68% by weight.

What is claimed is:

1. A method of regeneration of a spent etching solution containing cupric chloride and a metal chloride selected from the group consisting of cuprous chloride and ferrous chloride, comprising subjecting said solution to electrolysis with copper being reduced at the cathode, and the metal chloride being oxidized at the anode with simultaneous liberation of chlorine which is used for additional oxidation of said metal chloride.

2. The method as claimed in claim 1, wherein the oxidation of said metal chloride is conducted with the etching solution being fed along the anode countercurrent to the chlorine being liberated at a linear speed at least one and a half times exceeding that of said etching solution flowing along the cathode.

3. The method as claimed in claim 1, wherein a spent etching solution containing, in g-mol/l:

ferric chloride: 0.7 to 1.20
ferrous chloride: 0.32 to 0.40
cupric chloride: 0.98 to 1.5
chloride of an alkali metal: 1.1 to 2.0
hydrochloric acid: 0.2 to 0.8
water: up to 1 liter, and having a ratio of ferric chloride to cupric chloride of 1:1 to 1.55:1 is subjected to electrolysis at a current density of 8 to 35 A/cm$^2$, during which copper is reduced at the cathode, and bivalent iron is oxidized at the anode to trivalent iron with simultaneous liberation of chlorine which is used for additional oxidation of bivalent iron to trivalent iron, as a result, of which an etching solution of the following composition, in g-mol/l, is obtained:

ferric chloride: 0.9 to 1.4
ferrous chloride: 0.12 to 0.2
cupric chloride: 0.9 to 1.4
chloride of an alkali metal: 1.1 to 2.0
hydrochloric acid: 0.2 to 0.8
water: up to 1 liter with said ferric chloride to cupric chloride ratio.

4. A method as claimed in claim 3, wherein said oxidation of bivalent iron to trivalent iron is conducted with said etching solution being fed along the anode counter to the chlorine being liberated, at a linear speed at least one and a half times exceeding that of said etching solution flowing along the cathode.

5. A method as claimed in claim 1, wherein a spent etching solution containing cupric chloride and cuprous chloride is subjected to electrolysis at a current density of 15 to 80 A/dm$^2$.

* * * * *